US010647539B2

(12) United States Patent
Liu

(10) Patent No.: US 10,647,539 B2
(45) Date of Patent: May 12, 2020

(54) TENSION BUFFER SYSTEM FOR MULTI-WIRE PAY-OFF SYSTEM

(71) Applicant: NV Bekaert SA, Zwevegem (BE)

(72) Inventor: Xinghua Liu, Jiangsu (CN)

(73) Assignee: NV BEKAERT SA, Zwevegem (BE)

( * ) Notice: Subject to any disclaimer, the term of this patent is extended or adjusted under 35 U.S.C. 154(b) by 325 days.

(21) Appl. No.: 15/549,290

(22) PCT Filed: Feb. 5, 2016

(86) PCT No.: PCT/EP2016/052472
§ 371 (c)(1),
(2) Date: Aug. 7, 2017

(87) PCT Pub. No.: WO2016/128309
PCT Pub. Date: Aug. 18, 2016

(65) Prior Publication Data

US 2018/0022568 A1 Jan. 25, 2018

(30) Foreign Application Priority Data

Feb. 9, 2015 (WO) ..... PCT/CN2015/072533

(51) Int. Cl.
*B65H 59/36* (2006.01)
*D07B 7/02* (2006.01)

(52) U.S. Cl.
CPC ..... *B65H 59/36* (2013.01); *D07B 7/02* (2013.01); *B65H 2701/351* (2013.01); *D07B 2301/258* (2013.01)

(58) Field of Classification Search
CPC .... B65H 54/026; B65H 59/388; B65H 59/36; B65H 2701/38; B65H 2701/351; D07B 7/02; D07B 2301/258
See application file for complete search history.

(56) References Cited

U.S. PATENT DOCUMENTS 2,159,635 A * 5/1939 Ranney ..... B65H 59/16 242/411
2,417,780 A * 3/1947 Parvin ..... B21C 47/003 72/17.2

(Continued)

FOREIGN PATENT DOCUMENTS

CH 387 512 1/1965
DE 650 723 10/1937

(Continued)

OTHER PUBLICATIONS

International Search Report dated Apr. 20, 2016 in International (PCT) Application No. PCT/EP2016/052472.

*Primary Examiner* — William A. Rivera
(74) *Attorney, Agent, or Firm* — Wenderoth, Lind & Ponack, L.L.P.

(57) ABSTRACT

This invention relates to a tension buffer system for multi-wirepay-off system. The tension buffer system comprises guiding pulleys (4, 4*a*, 4*b*) adapted to guide wires (6, 6*a*, 6*b*) being paid off, and reversing pulleys (8). Each reversing pulley (8) is adapted to guide a wire (6, 6*a*, 6*b*) from the guiding pulley (4, 4*a*, 4*b*) and back to the guiding pulley (4, 4*a*, 4*b*), two reversing pulleys (8) are rotatably mounted on a first support (10), the first support (10) is pivoted around first support axis (12) lying between the two reversing pulleys (8) so that pivoting brings one of the two reversing pulleys (8) closer to the guiding pulley (4, 4*a*, 4*b*) while the other of the two reversing pulleys (8) more remote from said guiding pulley (4, 4*a*, 4*b*). This invention provides a mechanical device to balance the tension difference between multiple wires in the pay-off system to produce a steel cord with constant tension and satisfactory quality.

11 Claims, 3 Drawing Sheets

(56) References Cited

Figure 1:
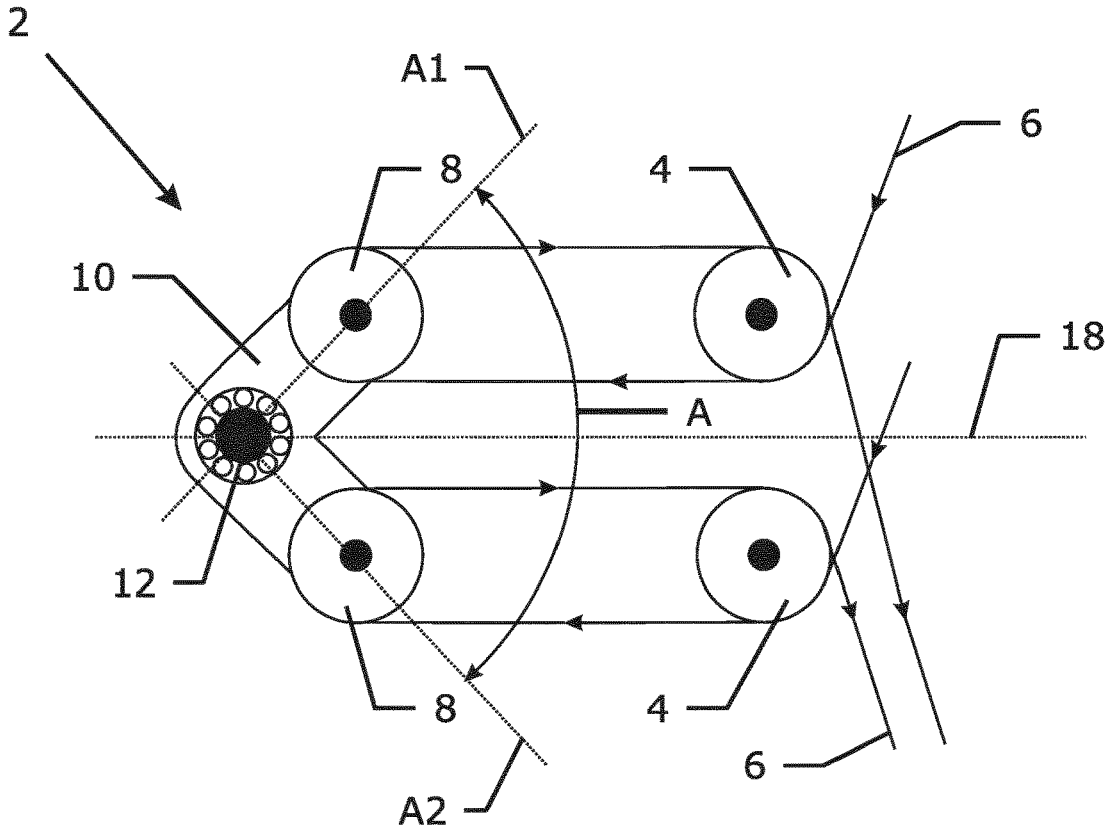

U.S. PATENT DOCUMENTS 2,929,569 A * 3/1960 Detrick ..... B21C 49/00 242/474.9
2,995,316 A * 8/1961 Burnell ..... B65H 59/36 242/147 R
3,346,019 A * 10/1967 Brosseit ..... B65H 59/36 140/71.5
3,477,653 A * 11/1969 Peene ..... B65H 59/36 242/470
3,533,358 A * 10/1970 Leuenberger ..... B63B 27/18 104/114
3,565,357 A * 2/1971 Takashi Noguchi ..... B65H 54/2851 242/413.4
3,578,795 A * 5/1971 Polese ..... B65H 59/385 242/413.5
4,062,504 A * 12/1977 Kitazawa ..... B65H 19/14 242/530.2
4,604,860 A * 8/1986 Matsuura ..... D07B 1/0693 57/311
5,169,479 A * 12/1992 Hoddinott ..... B65H 65/005 156/353
5,657,941 A * 8/1997 Simons ..... B65H 23/1825 242/420.6
2001/0002561 A1* 6/2001 Shiraga ..... B23D 57/0053 83/13
2004/0262444 A1* 12/2004 Robitaille ..... B65H 23/06 242/422.8
2008/0092510 A1 4/2008 Hsu
2012/0018564 A1* 1/2012 Schmitz ..... B21C 47/003 242/419.8
2019/0224734 A1* 7/2019 Nguen ..... B21C 47/02

FOREIGN PATENT DOCUMENTS

DE 967 171 10/1957
DE 29 49 842 9/1980

* cited by examiner

TENSION BUFFER SYSTEM FOR MULTI-WIRE PAY-OFF SYSTEM

TECHNICAL FIELD

The invention relates to a tension buffer system for multi-wire pay-off system, which provides a mechanical device to balance the tension difference between multiple wires in the pay-off system to produce a steel cord with constant tension and satisfactory quality.

BACKGROUND ART

It is known that the steel cord for the reinforcement of rubber products, for example pneumatic tires and conveyor belts, is made by twisting multiple wires together. In the twist process, each wire must be kept at a constant tensile before entering twist machine. In order to maintain the constant tension, most known devices are provided with an electronic detector to measure the tension of wires at a certain point and send the date to a processor and a motor to control the transport speed and the tension. It is not reliable that the electronic control has a time delay that leads to inaccuracy.

Prior art US2008/092510A1 discloses a mechanical tensile control device of a triple twist pay-off system, wherein wire tension is stabilized by the swing of weight block on the pivoted arm. But this device also has some drawbacks. Firstly, each of this tensile control device can only accommodate one wire, and multiple devices are needed according to the number of wires. Secondly, because of the difference on device manufacturing and assembly, the tension setting on devices can be different. Therefore, there is a need to provide a mechanical device which can not only accommodate multiple wires but also balance the tension difference between multiple wires.

DISCLOSURE OF INVENTION

The primary objective of present invention is to provide a tension buffer system for a multi-wire pay-off system to balance the tension difference between the multiple wires.

The second objective of present invention is to provide a simple and reliable tension buffer system which is robust and accurate to balance the tension difference between multiple wires.

According to present invention, a tension buffer system for a multi-wire pay-off system comprises guiding pulleys adapted to guide wires being paid off, and reversing pulleys. Each reversing pulley is adapted to guide a wire from the guiding pulley and back to the guiding pulley. Two reversing pulleys are rotatably mounted on a first support. The first support is pivoted around first support axis lying between the two reversing pulleys so that pivoting brings one of the two reversing pulleys closer to the guiding pulley while the other of the two reversing pulleys more remote from the guiding pulley.

The tension buffer system comprise at least two pairs of guiding pulley and reversing pulley.

Preferably, the tension buffer system further comprises a second support and another reversing pulley. The first support and the another reversing pulley are rotatably mounted on the second support. The second support is pivoted around second support axis lying between the first support and the another reversing pulley so that pivoting brings either one of the reversing pulleys on the first support or the another reversing pulley closer to the guiding pulley while the other reversing pulleys more remote from the guiding pulley.

Preferably, the tension buffer system further comprises a second support and another first support mounted with two reversing pulleys. The two first supports are rotatably mounted on the second support. The second support is pivoted around second support axis lying between the two first supports so that pivoting brings one of the two first supports closer to the guiding pulley while the other of the two first supports more remote from the guiding pulley.

Preferably, the guiding pulleys are con-centric.

Preferably, the angle A between the two lines connecting the centre of reversing pulleys on the first support and the centre of first support axis facing the guiding pulley is less than 180 degree.

Preferably, the angle B between the line connecting the centre of first support axis and the centre of second support axis and the line connecting the centre of another reversing pulley and the centre of the second support axis facing the guiding pulley is less than 180 degree.

Preferably, the angle C between the two lines connecting the centre of first support axis and the centre of second support axis facing the guiding pulley is less than 180 degree.

BRIEF DESCRIPTION OF FIGURES IN THE DRAWINGS

The invention will now be described into more detail with reference to the accompanying drawings.

FIG. 1 schematically shows a tension buffer system according to claim 1 of present invention.

Figure 2:
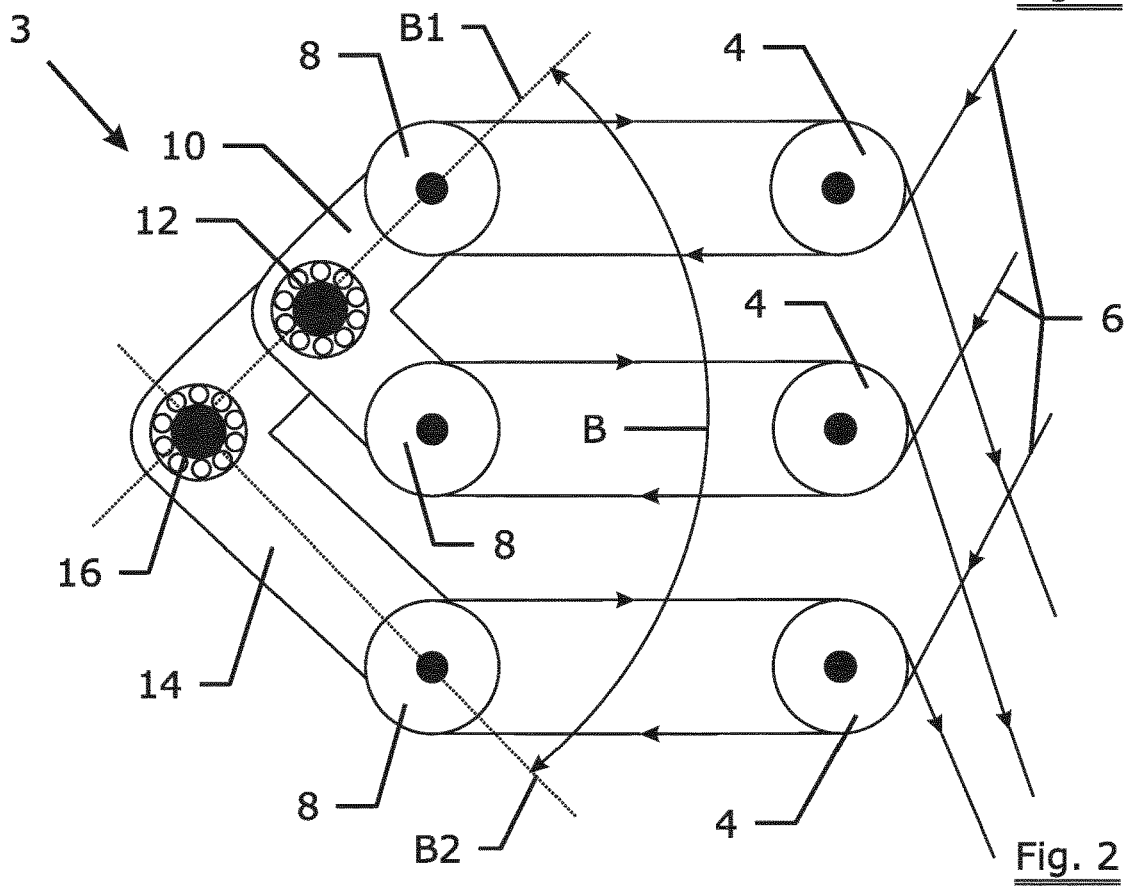

FIG. 2 schematically shows a tension buffer system according to claim 2 of present invention.

Figure 3:
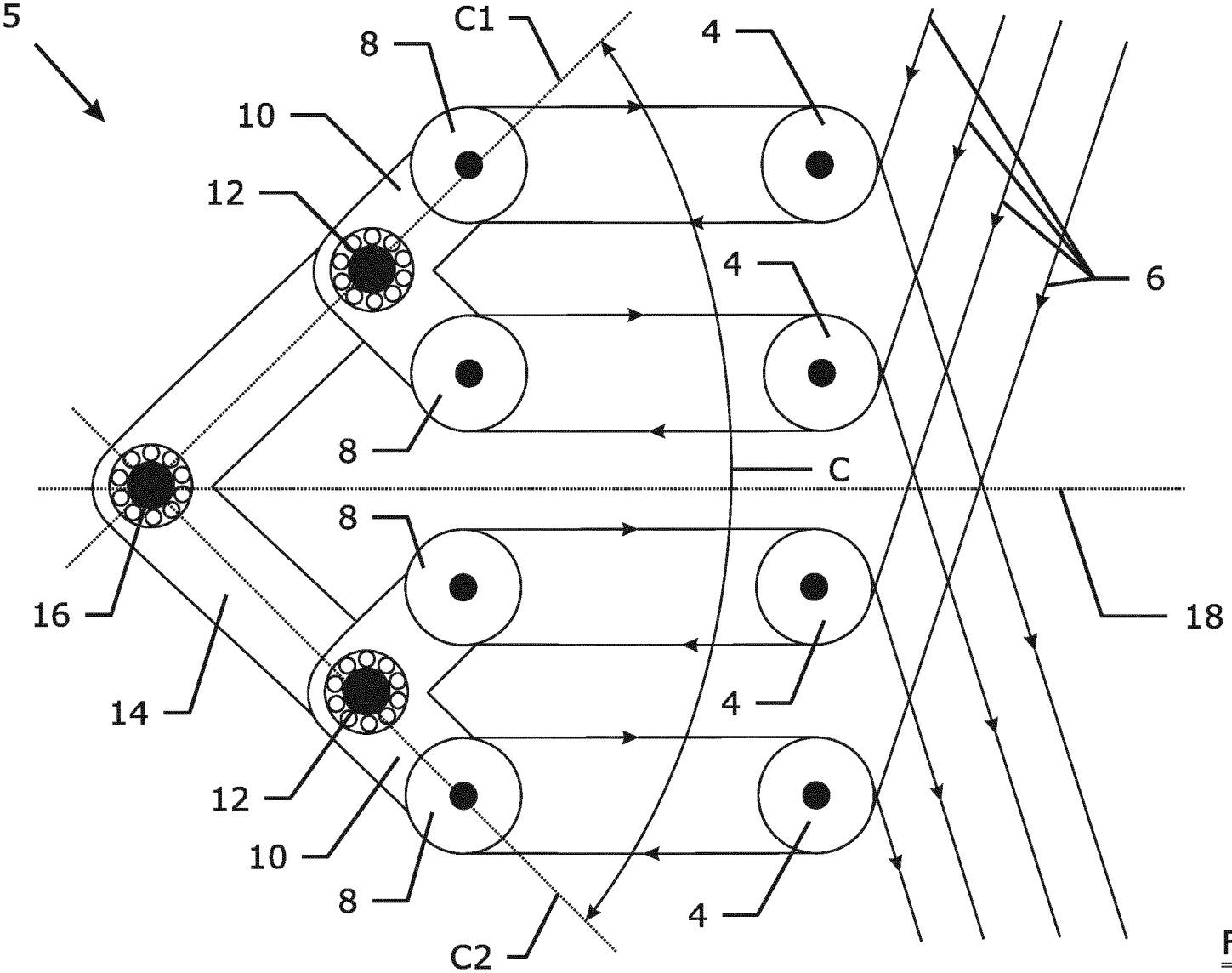

FIG. 3 schematically shows a tension buffer system according to claim 3 of present invention.

Figure 4:
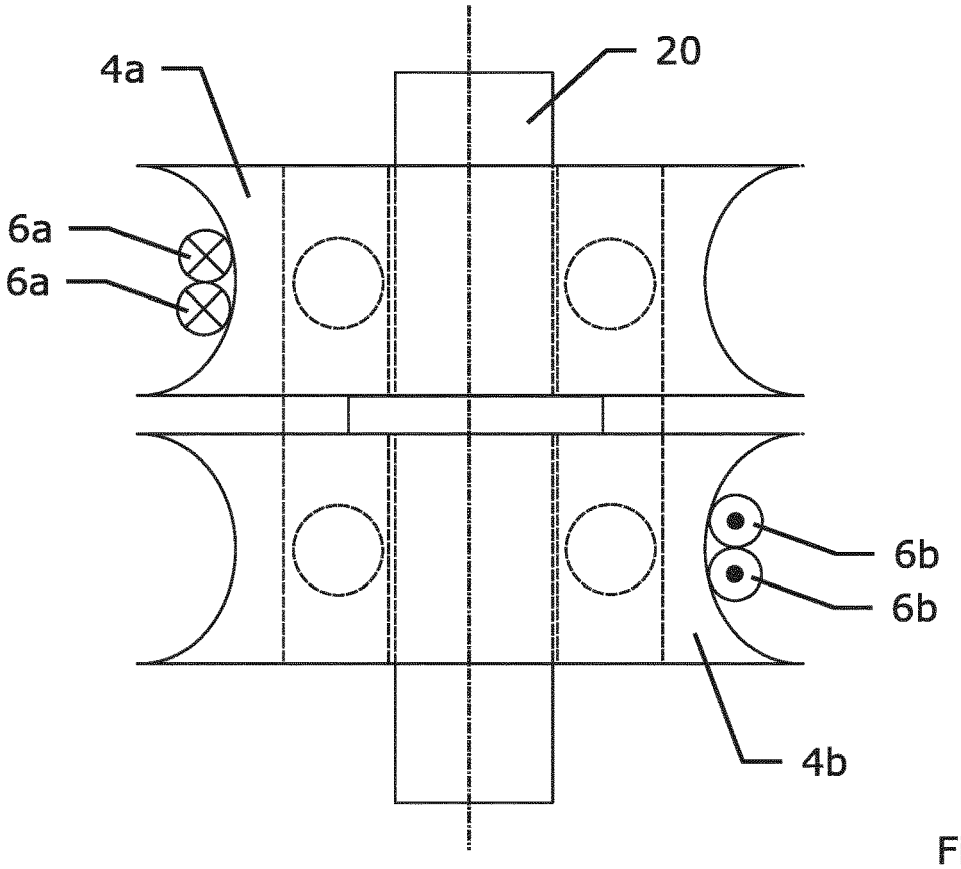

FIG. 4 schematically shows a side view of con-centric guiding pulleys.

Figure 5:
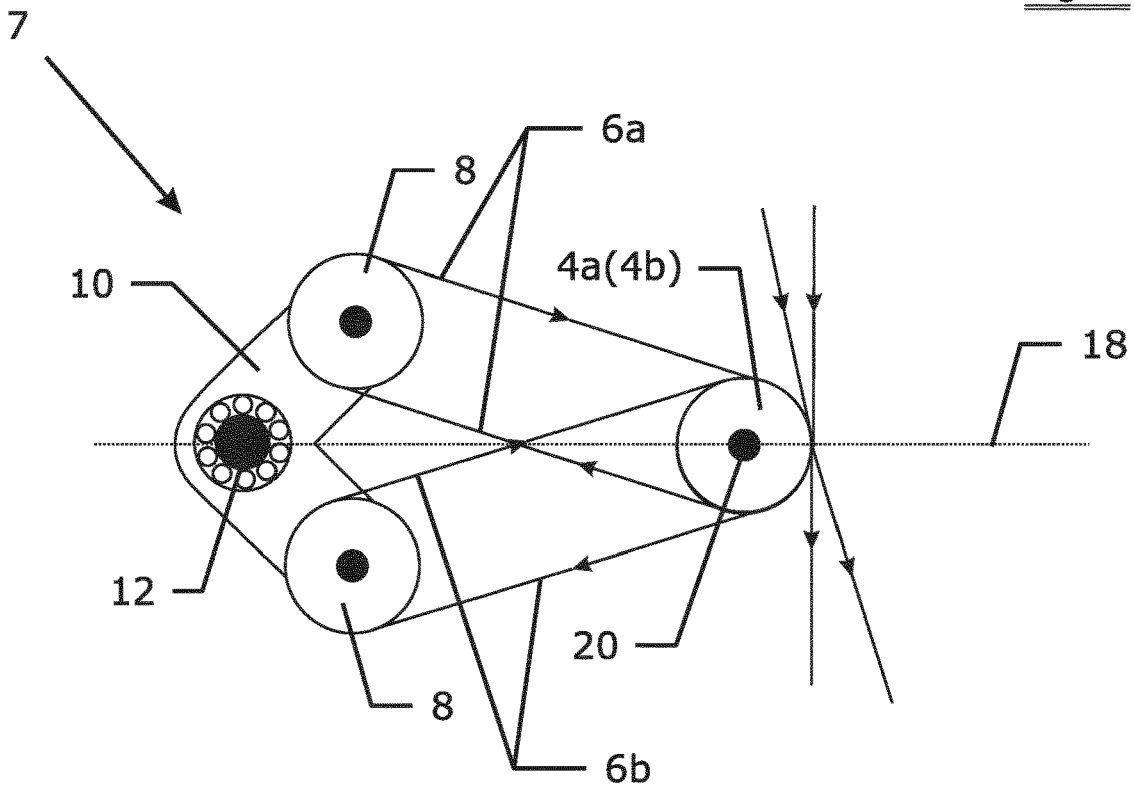

FIG. 5 schematically shows the mode to use con-centric guiding pulleys in a tension buffer system according to claim 1 of present invention.

MODE(S) FOR CARRYING OUT THE INVENTION

FIG. 1 schematically shows a tension buffer system according to claim 1 of present invention. The tension buffer system 2 comprises guiding pulleys 4 adapted to guide wires 6 being paid off, and reversing pulleys 8. Each reversing pulley 8 is adapted to guide a wire 6 from the guiding pulley 4 and back to the guiding pulley 4. Two reversing pulleys 8 are rotatably mounted on a first support 10. The first support 10 is pivoted around first support axis 12 lying between the two reversing pulleys 8 so that pivoting brings one of the two reversing pulleys 8 closer to the guiding pulley 4 while the other of the two reversing pulleys 8 more remote from the guiding pulley 4. In the pay-off operation, the wire 6 is led firstly passing the guiding pulley 4 toward the reversing pulley 8. After a U turn at the reversing pulley 8 the wire 6 is led back and further passing the guiding pulley 4. The arrows on the wire 6 show the direction of the wire movement.

Since the tension buffer system 2 comprises two pairs of guiding pulley 4 and reversing pulley 8, there are two wires 6 being paid-off in the system. In operation, each wire 6 exerts a force F on the reversing pulley 8, and the force F exerts a torque to the first support axis 12. If the torques exerted by the two wires 6 are equal, the tension buffer system stays stable. If the tensions of the two wires 6 are different, the higher the tension the higher the force F, the torque difference will drive the pivoting of the first support 10, which brings the reversing pulley 8 with higher tension closer to the guiding pulley 4 while the reversing pulley 8 with lower tension more remote from the guiding pulley 4. With this pivoting, higher tension is reduced because the reversing pulley 8 goes closer to the guiding pulley 4, while the lower tension is increased because the reversing pulley 8 goes more remote to the guiding pulley 4. With above mechanism, the tension difference between wires 6 is balanced by the pivoting of the first support 10. According to physics principle, torque T=distance vector r×force vector F, if the distance vector r is set equal, the torque T will be equal when the force vector F is equal. Therefore, to simplify the tension buffer system, it is better to set the first support 10, the reversing pulleys 8 and guiding pulleys 4 in a symmetric structure against the centre line 18 connecting the centre of first support axis 12 and the center of the guiding pulleys 4. In a symmetric structure, the distance vectors r for the two reversing pulleys 8 are equal, and the equal tension force on the two reversing pulleys 8 will keep the first support 10 in balance.

The angle A between the two lines A1 and A2 connecting the centre of reversing pulleys 8 on the first support 10 and the centre of first support axis 12 facing the guiding pulley 4 is less than 180 degree. This design provides a free swing of the buffer system to balance the tension difference between the two wires 6. The angle A can be set at 180 degree or even more than 180 degree, but stops are needed to limit the swing of the buffer system.

FIG. 2 schematically shows a tension buffer system according to claim 2 of present invention. The tension buffer system 3 further comprises a second support 14 and another reversing pulley 8. The first support 10 and the another reversing pulley 8 are rotatably mounted on the second support 14. The second support 14 is pivoted around second support axis 16 lying between the first support 10 and the another reversing pulley 8 so that pivoting brings either one of the reversing pulleys 8 on the first support 10 or the another reversing pulley 8 closer to the guiding pulley 4 while the other reversing pulleys 8 more remote from the guiding pulley 4. Just as explained in FIG. 1, the tension difference between the wires 6 on the two reversing pulleys 8 on the first support 10 can be balanced by the pivoting of the first support 10. Further, the joint force exerted by the wires 6 on the first support 10 can be balanced with the force exerted by the wire 6 on the another reversing pulley 8 by the pivoting of second support 14, for the same reasoning as long as the torque exerted by the joint force on the first support 10 to the second support axis 16 equals to the torque exerted by the force on the another reversing pulley 8 to the second support axis 16. Since the joint force on the first support 10 is about 2 times the force on the another reversing pulley 8, without the consideration on the force and moment due to gravity and friction, the distance vector for the another reversing pulley 8 should be 2 times the distance vector for the first support axis 12.

The angle B between the line B1 connecting the centre of first support axis 12 and the centre of second support axis 16 and the line B2 connecting the centre of another reversing pulley 8 and the centre of the second support axis 16 facing the guiding pulley 4 is less than 180 degree. This design provides a free swing of the buffer system to balance the tension difference between the wires 6. The angle B can be set at 180 degree or even more than 180 degree, but stops are needed to limit the swing of the buffer system.

FIG. 3 schematically shows a tension buffer system according to claim 3 of present invention. The tension buffer system 5 further comprising a second support 14 and another first support 10 mounted with two reversing pulleys 8. The two first supports 10 are rotatably mounted on the second support 14. The second support 14 is pivoted around second support axis 16 lying between the two first supports 10 so that pivoting brings one of the two first supports (10) closer to the guiding pulley 4 while the other of the two first supports 10 more remote from the guiding pulley 4. Just as explained in FIG. 1, the tension difference between the wires 6 on the two reversing pulleys 8 on the first support 10 can be balanced by the pivoting of the first support 10. Further, the joint force exerted by the wires 6 on the first support 10 can be balanced with the joint force exerted by the wires 6 on the other first support 10 by the pivoting of second support 14, for the same reasoning as long as the torques exerted by the joint force on the first support 10 to the second support axis 16 are equal. Therefore, to simplify the tension buffer system, firstly it is better to set the first support 10, the reversing pulleys 8 and guiding pulleys 4 in a symmetric structure against the centre line connecting the centre of first support axis 12 and the center of the guiding pulleys 4 as explained in FIG. 1. In a symmetric structure, the distance vectors r for the two reversing pulleys 8 are equal, and the equal tension force on the two reversing pulleys 8 will keep the first support 10 in balance. Secondly, it is better to set the second support 14, the two first supports 10 and the guiding pulleys 4 in a symmetric structure, against the centre line 18 connecting the centre of second support axis 16 and the centre of the guiding pulleys 4. In a symmetric structure, the distance vectors r for the two first supports 10 are equal, and the equal joint force on the two first supports 10 will keep the second support 14 in balance.

The angle C between the two lines C1 and C2 connecting the centre of first support axis 12 and the centre of second support axis 16 facing the guiding pulley 4 is less than 180 degree. This design provides a free swing of the buffer system to balance the tension difference between the wires 6. The angle C can be set at 180 degree or even more than 180 degree, but stops are needed to limit the swing of the buffer system.

For the similar reasoning, further adding a third support with corresponding second support 14 and first support 10, provides a tension buffer system for 5, 6, 7, 8 wires. Similarly, further adding more supports can provide a tension buffer system for more wires.

FIG. 4 schematically shows a side view of con-centric guiding pulleys. Two guiding pulleys 4*a* and 4*b* share the same axis 20. Two wires 6*a* and 6*b* (circle with X) firstly pass the guiding pulley 4*a* toward the reversing pulley 8. After a U turn at the reversing pulley 8, the two wires 6*a* and 6*b* (circle with point) are led back and pass the guiding pulley 4*b*. The two guiding pulleys 4*a* and 4*b* can be the same guiding pulley, and two wires 6*a* and 6*b* can be the same wire.

FIG. 5 schematically shows the mode to use con-centric guiding pulleys in a tension buffer system according to claim 1 of present invention. FIG. 5 is difference from FIG. 1 in that the guiding pulleys 4*a* and 4*b* are concentric guiding pulleys as shown in FIG. 4. Since 4*a* and 4*b* are concentric, guiding pulley 4*a* is visible on the top of the hiding guiding pulley 4*b*. Two wires 6*a* and 6*b* firstly pass the guiding pulley 4*a* toward the reversing pulley 8. After a U turn at the reversing pulley 8, the two wires 6*a* and 6*b* are led back and pass the guiding pulley 4*b*. The tension buffer system maintains a symmetric structure, wherein the first support 10, the reversing pulleys 8 and guiding pulleys 4*a* and 4*b* are in a symmetric structure against the centre line 18 connecting the centre of first support axis 12 and the center of the guiding pulleys 4*a* and 4*b*. In this symmetric structure, the distance vectors r for the two reversing pulleys 8 are equal, and the equal tension force on the two reversing pulleys 8 will keep the first support 10 in balance. Compared with the tension buffer system as shown in FIG. 1, the tension buffer system in FIG. 5 is compact with the same functionality. Similarly, con-centric guiding pulleys can be used in the tension buffer system as shown in FIG. 2 and FIG. 3, to provide a compact system with the same functionality.

The invention claimed is:

1. A tension buffer system (2, 3, 5, 7) for a multi-wire pay-off system, said system comprising guiding pulleys (4, 4*a*, 4*b*) adapted to guide wires (6, 6*a*, 6*b*) being paid off, said system further comprising reversing pulleys (8), each reversing pulley (8) being adapted to guide a wire (6, 6*a*, 6*b*) from the guiding pulley (4, 4*a*, 4*b*) and back to the guiding pulley (4, 4*a*, 4*b*), two of said reversing pulleys (8) being rotatably mounted on a first support (10), said first support (10) being pivoted around first support axis (12) lying between said two reversing pulleys (8) so that pivoting brings one of said two reversing pulleys (8) closer to the guiding pulley (4, 4*a*, 4*b*) while the other of said two reversing pulleys (8) more remote from said guiding pulley (4, 4*a*, 4*b*).

2. A tension buffer system as claimed in claim 1, said system further comprising a second support and another reversing pulley, said first support and said another reversing pulley being rotatably mounted on said second support, said second support being pivoted around second support axis lying between said first support and said another reversing pulley so that pivoting brings either one of said reversing pulleys on said first support or said another reversing pulley closer to the guiding pulley while the other reversing pulleys more remote from said guiding pulley.

3. A tension buffer system as claimed in claim 2, an angle B between the line connecting the centre of first support axis and the centre of second support axis and the line connecting the centre of said another reversing pulley and the centre of said second support axis facing the guiding pulley is less than 180 degree.

4. A tension buffer system as claimed in claim 2, said guiding pulleys are concentric.

5. A tension buffer system as claimed in claim 2, an angle A between the two lines connecting the centre of reversing pulley on the first support and the centre of first support axis facing the guiding pulley is less than 180 degree.

6. A tension buffer system as claimed in claim 1, said system further comprising a second support and another first support mounted with two reversing pulleys, said two first supports being rotatably mounted on said second support, said second support being pivoted around second support axis lying between said two first supports so that pivoting brings one of said two first supports closer to the guiding pulley while the other of said two first supports more remote from said guiding pulley.

7. A tension buffer system as claimed in claim 6, an angle C between the two lines connecting the centre of first support axis and the centre of second support axis facing the guiding pulley is less than 180 degree.

8. A tension buffer system as claimed in claim 6, said guiding pulleys are concentric.

9. A tension buffer system as claimed in claim 6, an angle A between the two lines connecting the centre of reversing pulley on the first support and the centre of first support axis facing the guiding pulley is less than 180 degree.

10. A tension buffer system as claimed in claim 1, said guiding pulleys are concentric.

11. A tension buffer system as claimed in claim 1, an angle A between the two lines connecting the centre of reversing pulley on the first support and the centre of first support axis facing the guiding pulley is less than 180 degree.

* * * * *